United States Patent [19]

Shacham et al.

[11] Patent Number: 4,774,788

[45] Date of Patent: Oct. 4, 1988

[54] GRINDING WHEEL WITH A SINGLE-PIECE HUB

[75] Inventors: Amnon Shacham, Kibbutz Sarid; Eitan Rogel, Haifa, both of Israel

[73] Assignee: Camel Grinding Wheel Works, Sarid Ltd., Post Sarid, Israel

[21] Appl. No.: 835,165

[22] Filed: May 6, 1986

[51] Int. Cl.[4] ..... B24B 45/00

[52] U.S. Cl. ..... 51/168; 249/84

[58] Field of Search ..... 51/168, 170 T, 389, 51/293, 295, 297, 298; 264/267, 273, 274, 275, 259, 262; 249/84, 87, 88

[56] References Cited

U.S. PATENT DOCUMENTS

| | | | |
|---|---|---|---|
| 3,354,510 | 11/1967 | Cook | 264/273 |
| 3,879,178 | 4/1975 | Bosma | 51/168 |
| 4,015,371 | 4/1977 | Grayston | 51/168 |
| 4,088,729 | 5/1978 | Sherman | 264/259 |
| 4,240,230 | 12/1980 | Ferrantini | 51/168 |
| 4,541,205 | 9/1985 | Patrello | 51/168 |

FOREIGN PATENT DOCUMENTS

| | | | |
|---|---|---|---|
| 2530835 | 1/1977 | Fed. Rep. of Germany | 51/168 |
| 753621 | 8/1980 | U.S.S.R. | 51/168 |

*Primary Examiner*—Roscoe V. Parker

*Attorney, Agent, or Firm*—Kenyon & Kenyon

[57] ABSTRACT

A mounting hub for securing an abrasive grinding wheel to a grinding machine spindle, the hub being formed in a single, integral piece of polymer plastic material. Flanges on each wheel face grip the wheel faces, and a mounting projection provides a spindle bore for receiving the grinding machine spindle. The hub is molded directly on the wheel, resulting in the formation of an interpenetration zone at the hub/wheel interface, in which the abrasive material of the wheel and the polymer plastic material intermix and mesh, producing a strong, durable bond.

5 Claims, 1 Drawing Sheet

GRINDING WHEEL WITH A SINGLE-PIECE HUB

BACKGROUND OF THE INVENTION

The present invention relates to the field of abrasive grinding, and more particularly to the field of grinding wheels having a hub for mounting the wheel to a grinding machine.

The many grinding applications employing an abrasive wheel mounted on a grinding machine has led to the development of a wide variety of wheel shapes and sizes. One type of grinding wheel tailored for specific applications is the depressed center wheel, characterized by the central portion of the wheel being laterally offset from the wheel periphery so that one face has a depressed central portion and the other has a raised central portion. This design allows a user to perform face grinding operations, using the wheel face of the side having the depressed center. Typically such operations are performed on metal, masonry or concrete surfaces and the like, using portable grinding machines.

Safety, of course, is a primary consideration in this art; wheels typically operate at high rotational speeds, and failure can cause an "explosion" of the wheel, resulting in portions of abrasive material flying in many directions at high velocity. Therefore, the art has adopted uniform design and safety standards, published as American National Standards Institute (ANSI) Standard B7.1, hereby incorporated herein by reference. Depressed center wheels are classified as ANSI Types 27 and 28.

The means by which a grinding wheel is secured to the grinding machine spindle is important generally, and of particular significance to depressed center wheels. In general, the mounting means must be capable of holding the wheel exactly perpendicular to the spindle, and it must provide support to the wheel to distribute stresses away from the central mounting aperture, where stresses are at a maximum. The mounting means also must be firmly secured to the abrasive wheel, to prevent any slippage. In addition, the mounting means for Types 27 and 28 wheels must provide extra support to the back (non-grinding) face of the wheel, due to the additional stresses imposed by face grinding, particularly when the grinding is done with hand-held equipment. Therefore, the ANSI Standard requires that special mounting means be employed for Types 27 and 28 wheels, including a flange over the raised portion, extending beyond the raised area and in contact with the wheel to counteract side pressure. On the opposite side of the wheel, a flange must also be provided, contained completely within the depressed area.

The art has responded to these requirements by providing mounting means in the form of hub assemblies comprising several pieces, secured to the wheel by friction or resin bonding. The hub assembly in most general use comprises two parts. An adaptor includes a flange covering the raised area, having a mounting projection for attachment to the machine spindle and a sleeve extending through the mounting aperture. A flange nut is carried within the depressed area, with a sleeve extending into the mounting aperture to engage the adaptor, typically by threads. Such an arrangement depends entirely upon the nut being properly tightened, of course, and offers the potential for a high degree of hazard. Alternatively, the two pieces can be bonded to the wheel, as with epoxy resin.

Typical of proposed improvements in this art is U.S. Pat. No. 3,879,178, to Bosma. There, a tubular member extends through the wheel's central aperture, having a flange at its end in engagement with the depressed area of the wheel. A backpad is fitted over the tube to cover the raised area, and the tube is axially compressed, crimping it to the wheel. Clearly, this type of assembly not only is relatively cumbersome, but also it provides limited ability to counteract side pressure and to hold the wheel securely without slippage.

Other proposed solutions rely upon some form of mechanical interlock between the hub assembly and the wheel, to provide rotational stability. For example, U.S. Pat. Nos. 4,015,371, to Grayston, 4,240,230, to Ferrantini, and 4,541,205, to Patrello, all disclose hub assemblies having a sleeve extending through the wheel mounting aperture and crimped thereto, with some portion of the assembly mating with a specially-formed portion of the wheel. Grayston teaches the formation of indentations spaced around the aperture, receiving raised portions of the hub; Ferrantini offers similar indentations, but places them in the wheel periphery, engaged by bosses on the inner side of the flange rim; and Patrello employs bushings, formed into the wheel's mounting aperture during wheel manufacture, having a keyway to receive a key in the hub assembly. All of these approaches suffer from the defect of complicating the manufacturing process by requiring additional steps. Also, introduction of point loading areas, particularly in Grayston and Ferrantini, produces stress concentration areas that can lead to early wheel failure.

Additionally, the hub assemblies found in the art form a significant proportion of the total product weight. Given the reliance upon crimping and pressure fit, the art employs metallic hub assemblies, with the crimped modules generally being a zinc or aluminum alloy. Thus, the hub assembly leads to increased shipping costs. The art has heretofore failed to offer a grinding wheel hub assembly that is simple to manufacture, yet combines high safety with light weight.

SUMMARY OF THE INVENTION

It is an object of the present invention to provide a light-weight, single-piece mounting hub for a grinding wheel.

A further object of the invention is provision of a mounting hub assembly integrally molded to a grinding wheel body.

Another object of the invention is a method for producing a hub for a grinding wheel, in which the hub assembly is formed directly on the wheel body, as by injection molding of a polymer plastic material.

This and other objects are achieved by the present invention, in which a mounting hub for an abrasive grinding wheel is a single-piece unit, integrally molded to the wheel. In a preferred embodiment, mounted on a recessed center wheel, the hub includes a cutting face flange, in engagement with the recessed area, a backing flange overlapping the raised area and engaging the wheel backing face, the backing flange including a mounting portion defining a spindle bore for receiving the grinding machine spindle. An interpenetration zone exists at the hub/wheel interface, in which portions of the polymeric plastic material and wheel abrasive material intermix and mesh, producing an extremely strong, durable bond.

DETAILED DESCRIPTION OF A PREFERRED EMBODIMENT

Figure 1:
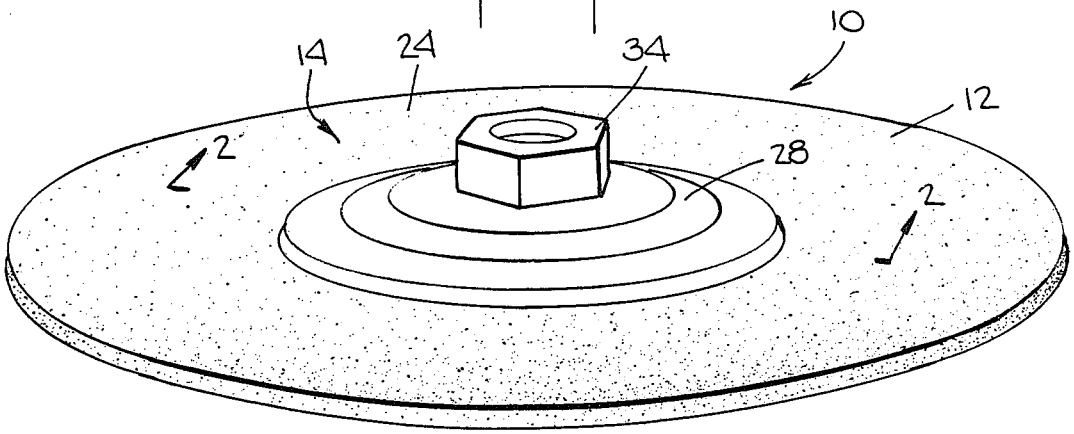
FIG. 1 is a perspective of an embodiment of the present invention.
Figure 2:
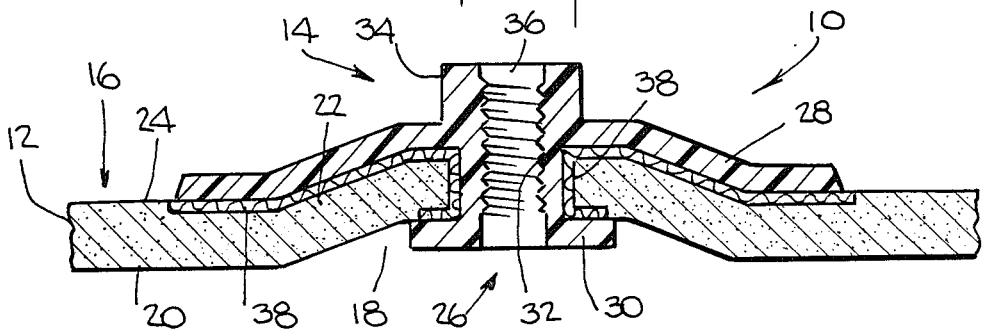
FIG. 2 is a side view, in cross-section, of the embodiment of FIG. 1.

FIGS. 1 and 2 depict an embodiment 10 of the present invention. A grinding wheel 12 is shown, having the configuration of an ANSI Type 27 wheel. It should be understood that those in the art advantageously may adapt the present invention to various types of wheels, and the discussion herein in no way limits the invention to the wheel type illustrated.

Type 27 wheels are characterized by the offset central portion 14, surrounded by the peripheral portion 16. The offset creates a depression 18 in the cutting face 20 of the wheel, and a raised area 22 on the opposite side of the wheel, backing face 24. At the center of the wheel body, a mounting aperture 26 extends through the wheel to receive a mounting means. The wheel is formed, as known to the art, of abrasive material, bonded by an organic material such as a resin.

Mounting hub 10 is an intergrally-molded, single-piece assembly, molded directly on the wheel body. The unit can be described in terms of its several portions, but it should be borne in mind that the portions are not separate units. The raised area 22 of the backing face is covered by backing flange 28. As required by ANSI Standard B7.1, this flange extends completely over the raised area and overlaps the peripheral area 16 of the wheel. It will be appreciated that the width of this flange provides substantial support to counteract stresses imposed when grinding with cutting face 20. This flange should be approximately ⅜" thick, and it makes contact with the wheel body on its entire inner surface.

Cutting face flange 30 engages the portion of the wheel body surrounding the cutting face end of mounting aperture 26. This flange is located entirely within recessed area 18, and an aperture fitting portion 32 of the hub extends between the two flanges, bearing against the inner surface of the mounting aperture.

Extending upward perpendicularly from the center of backing flange 28 is a mounting projection 34. This component facilitates mounting the wheel on a grinding machine spindle (not shown), received into spindle bore 36, which may pass completely through the hub assembly, coaxial with the mounting aperture. Preferably, the walls of the spindle bore are threaded for attachment to threaded spindles, as are most often employed in the art. Also, it has been found convenient to provide the exterior of the mounting projection in the shape of a nut, preferably hexagonal, for easy tightening with a wrench.

Two important factors provide for the stability of the hub of the present invention. First, the plastic material is formed at relatively high injection pressure, typically about 500 kg/cm$^2$. Thus, as the plastic material of flanges 28 and 30 cures (with concomittant shrinking of the plastic material), these components exert a high clamping pressure upon the wheel surface, providing a firm mechanical grip.

More important, however, is the formation of an interpenetration zone 38, where a portion of the plastic material penetrates the surface of the wheel abrasive material, forming a zone in which the hub material and the wheel material mesh, producing a bond highly resistant to stresses, particularly stresses acting in the planes of the wheel faces. It has been found that the plastic material penetrates the surface of the abrasive material to a depth of up to 1 mm. Because this interpenetration zone extends over the entire area at which the hub makes contact with the wheel, an extremely strong, durable bond is formed.

The plastic material of which the hub is formed may be chosen from among these polymer plastics known to the art, having properties of strength and durability. Nylon, polystyrene, polyacetal, and polyester plastics have been found to yield acceptable results. Also, it has been found advantageous to reinforce the plastic material with material such as fiberglass for additional strength. It is preferred to employ a nylon material, reinforced with fiberglass in a weight ratio of about 7:3.

The process for producing the present invention can generally be described as providing a mold assembly designed to produce the hub assembly, clamping that mold assembly to the wheel body, and forming the mounting hub. It should be noted that the prior art has depended exclusively on processes whereby a hub assembly and wheel body are separately manufactured, and then the hub is fitted to the wheel by some assembly process. The method of the present invention eliminates a step of that procedure by combining the hub manufacturing and assembly processes. Surprisingly, not only is the process streamlined and improved, but also a superior product is produced.

Figure 3:
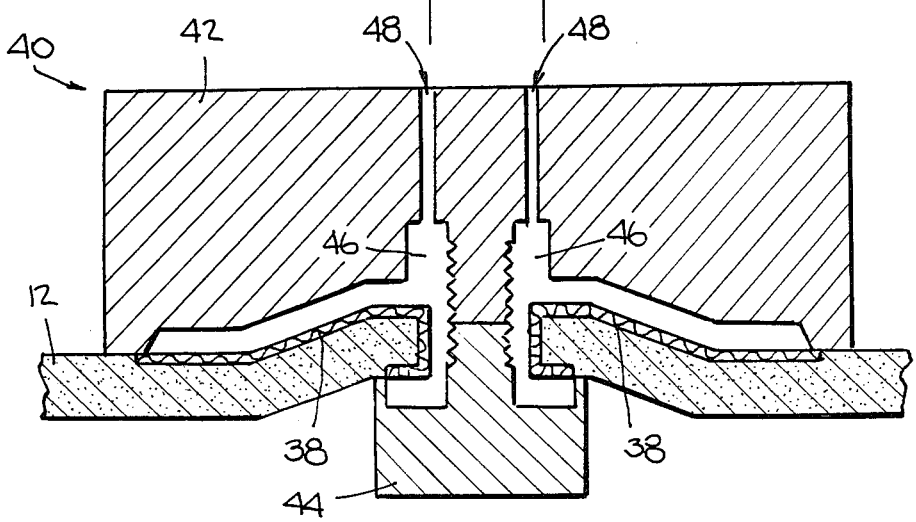
FIG. 3 is a schematic side view, in cross-section, of an embodiment of the process of the present invention.

As seen in FIG. 3, the wheel 12 is clamped firmly within a mold body 40, which includes a top mold 42 and bottom mold 44. A mold cavity 46 is machined into the mold halves to replicate the form of hub assembly 10. Passages 48 communicate with a source of plastic materal (not shown), which supplies plastic material to the mold cavity. The plastic material fills the cavity and a portion penetrates the surface of the abrasive material, creating interpenetration zone 38. The plastic material is then cured, as known in the art.

It will be apparent to those in the art that the invention can be modified in various ways. For example, types of grinding wheels other than Type 27 wheels could be fabricated according to the invention. Also, other types of plastic material could be used to form the invention. These and other changes, alterations and modifications can be made without departing from the scope of the invention, which is defined solely by the claims appended hereto.

We claim:

1. A grinding wheel hub assembly, for mounting an abrasive grinding wheel having a mounting aperture on a grinding apparatus, comprising:

a cutting face flange, extending radially outward from the mounting aperture and engaged with the cutting face of the wheel;

an aperture fitting, integral with said cutting face flange, extending through and in engagment with the surface of the mounting aperture;

a backing flange, integral with said aperture fitting, extending radially outward from the mounting aperture and in engagement with the backing face of the wheel, having integral mounting projection means for mounting the wheel on the grinding apparatus spindle;

said cutting face flange, said backing flange and said aperture fitting being formed of a high-strength plastic material and dimensioned to transmit driving forces to the grinding wheel and to provide structural support to the grinding wheel when the wheel is mounted on the grinding apparatus; and an interpenetration zone disposed at locations where said flanges and said aperture fitting engage the wheel body, wherein portions of said cutting flange, aperture fitting and backing flange penetrate the surface of the wheel body for securing said flanges and said aperture fitting to same.

2. The hub assembly of claim 1, wherein said flanges and said aperture fitting are formed of integrally-molded piece of polymeric plastic material.

3. The hub assembly of claim 2, wherein said polymeric plastic material is selected from the group consisting of polyester, polystyrene, polyacetal or nylon plastic.

4. The hub assembly of claim 2 wherein said polymeric plastic material is a nylon material reinforced with a fiberglass material.

5. In a hub assembly mounted in the mounting aperture of an abrasive grinding wheel having a cutting face flange engaging one face of the wheel, connected with a backing flange engaging the opposite face of the wheel, the improvement wherein:

the hub is a single unit of integrally-molded polymeric plastic material, the hub assembly further comprising an interpenetration zone at areas where the hub makes contact with the wheel, wherein portions of said polymeric plastic material intermix and mesh with the wheel abrasive material to secure the hub to the wheel.

* * * * *